US008553912B2

(12) United States Patent
Wang et al.

(10) Patent No.: US 8,553,912 B2
(45) Date of Patent: Oct. 8, 2013

(54) THERMOACOUSTIC DEVICE

(75) Inventors: Yu-Quan Wang, Beijing (CN); Li Qian, Beijing (CN); Chen Feng, Beijing (CN); Liang Liu, Beijing (CN)

(73) Assignee: Beijing FUNATE Innovation Technology Co., Ltd., Beijing (CN)

( * ) Notice: Subject to any disclaimer, the term of this patent is extended or adjusted under 35 U.S.C. 154(b) by 344 days.

(21) Appl. No.: 12/954,753

(22) Filed: Nov. 26, 2010

(65) Prior Publication Data

US 2011/0274297 A1 Nov. 10, 2011

(30) Foreign Application Priority Data

May 10, 2010 (CN) ..... 2010 1 0167401

(51) Int. Cl.
*H04R 25/00* (2006.01)

(52) U.S. Cl.
USPC ..... 381/164

(58) Field of Classification Search
USPC ..... 381/164, 111, 423, 426; 977/932, 742; 367/140
See application file for complete search history.

(56) References Cited

U.S. PATENT DOCUMENTS 6,994,584 B1 * 2/2006 Santana et al. ..... 439/485
7,402,909 B2 * 7/2008 Suh et al. ..... 257/753
2002/0186113 A1 * 12/2002 Hjortstam et al. ..... 336/55
2005/0201575 A1 * 9/2005 Koshida et al. ..... 381/164
2009/0323476 A1 * 12/2009 Jiang et al. ..... 367/140
2010/0046774 A1 * 2/2010 Feng et al. ..... 381/164
2010/0046784 A1 * 2/2010 Jiang et al. ..... 381/386

FOREIGN PATENT DOCUMENTS

CN 101594563 A 12/2009
CN 101605290 A 12/2009

OTHER PUBLICATIONS

"Flexible, Stretchable, Transparent Carbon Nanotube Thin Film Loudspeakers", Fan et al., Nano Letters, vol. 8, No. 12, p. 4539-4545(2008).

* cited by examiner

*Primary Examiner* — Suhan Ni
(74) *Attorney, Agent, or Firm* — Altis & Wispro Law Group, Inc.

(57) ABSTRACT

A thermoacoustic device includes a sound wave generator, a signal element and a support element. The sound wave generator includes a carbon nanotube structure. The signal element is configured to transmit a signal. The carbon nanotube structure is configured to receive the signal and generate a sound wave. The support element includes a metal substrate and an insulating layer located on the metal substrate. The insulating layer is sandwiched between the metal substrate and the sound wave generator. The thermoacoustic device further includes two electrodes electrically connected to the carbon nanotube structure.

20 Claims, 4 Drawing Sheets

THERMOACOUSTIC DEVICE

RELATED APPLICATIONS

This application claims all benefits accruing under 35 U.S.C. §119 from China Patent Application No. 201010167401.8, filed on May 10, 2010 in the China Intellectual Property Office, the disclosure of which is incorporated herein by reference.

BACKGROUND

1. Technical Field

The present disclosure relates to acoustic devices, particularly, to a thermoacoustic device.

2. Discussion of Related Art

Acoustic devices generally include a signal element and a sound wave generator. The signal element inputs signals to the sound wave generator such as a loudspeaker. Loudspeaker is an electro-acoustic transducer that converts electrical signals into sound.

Thermoacoustic effect is a conversion between heat and acoustic signals. When signals are inputted into a thermoacoustic element, heating is produced in the thermoacoustic element according to the variations of the signal and/or signal strength. Heat is propagated into surrounding medium. The heating of the medium causes thermal expansion and produces pressure waves in the surrounding medium, resulting in sound wave generation. Such an acoustic effect induced by temperature waves is commonly called "the thermoacoustic effect".

A loudspeaker based on the thermoacoustic effect was created by Fan et al. ("Flexible, Stretchable, Transparent Carbon Nanotube Thin Film Loudspeakers", Nano Letters, Vol. 8, No. 12, p 4539-4545 (2008)). The loudspeaker includes a carbon nanotube film acting as a thermoacoustic element. The carbon nanotube film is flexible, and easily shaped. Metal has good plasticity properties and can be formed into various shapes. The methods for manufacturing metal are mature. Thus, the metal generally can form a metal supporter to support a flexible film. However, the carbon nanotube film and metal both have electrically conductive properties, if the carbon nanotube film is located on the metal supporter, it will be easy short circuit. Thus, the loudspeaker cannot generate sound. Therefore, the thermoacoustic device is not suitable for employing a metal supporter.

A thermoacoustic device employing a metal supporter is provided.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
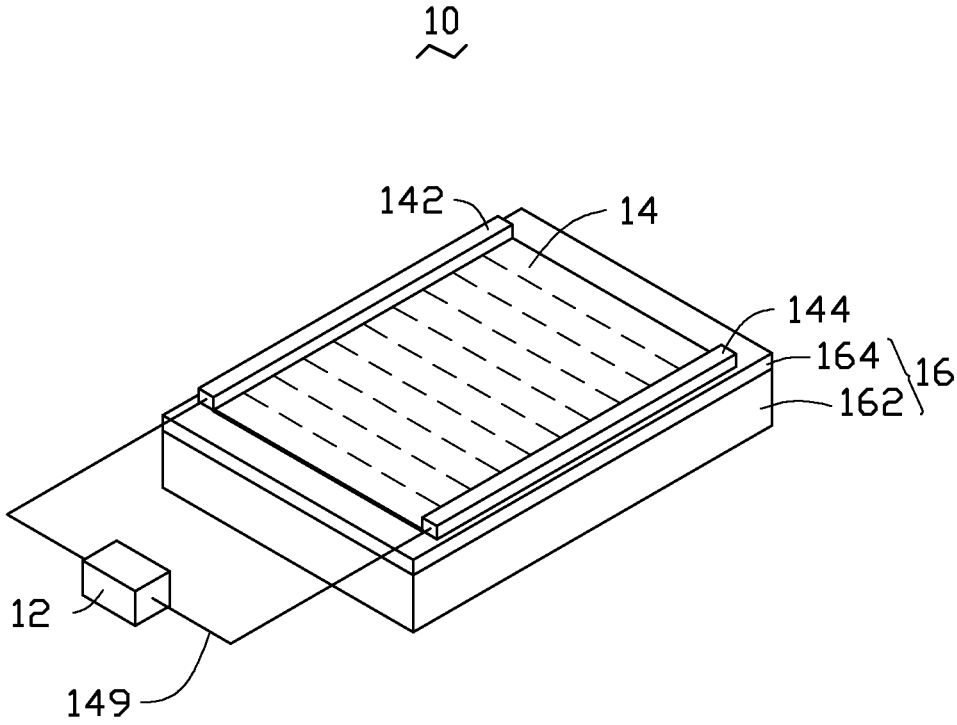
FIG. 1 is a schematic structural view of a thermoacoustic device in accordance with one embodiment.

Referring to FIG. 1, a thermoacoustic device 10 according to one embodiment includes a signal element 12, a sound wave generator 14, a first electrode 142, a second electrode 144, and a support element 16. The sound wave generator 14 is disposed on the support element 16. The support element 16 supports the sound wave generator 14. The first electrode 142 and the second electrode 144 are located apart from each other, and are electrically connected to the sound wave generator 14. The first electrode 142 and the second electrode 144 are electrically connected to the signal element 12. The first electrode 142 and the second electrode 144 input signals from the signal element 12 to the sound wave generator 14.

The support element 16 can have a planar surface or a curved surface. The shape of the support element 16 can be cube, cone, cylinder, sphere, or semi-sphere. The shape of the support element 16 can be selected as desired.

The support element 16 includes a metal substrate 162 and an insulating layer 164 located on the metal substrate 162. The sound wave generator 14 is disposed on the insulating layer 164. The sound wave generator 14 is substantially parallel to and attached on the insulating layer 164. The resistance of the insulating layer 164 is larger than that of the sound wave generator 14.

The material of the metal substrate 162 can be a pure metal or an alloy, such as aluminum, iron, copper, nickel, sliver, gold, or an alloy of any combination thereof. A thickness of the metal substrate 162 can be selected as desired.

The insulating layer 164 can have excellent electrically insulation properties. In one embodiment, the resistance of the insulating layer 164 can be larger than $1\times10^4\Omega$, the resistance ratio of the insulating layer 164 and the sound wave generator 14 can be more than or equal to 10, to maintain enough electro-heat conversion efficiency of the sound wave generator 14. Further, the insulating layer 164 also can have good thermally insulated property, to avoid the heat emitting from the sound wave generator 14 from being excessively absorbed by the support element 16. If too much of the heat is absorbed by the support element 16, the heat will not create enough to heat the surrounding medium, such as air, nitrogen gas or other substances surrounding the sound wave generator 14 to emit sound. In addition, in a microscopic view, a surface of the insulating layer 164 in contact the sound wave generator 14 can have a coarse surface, to obtain a larger contact area between the sound wave generator 14 and the thermoacoustic device 10. Thus, the sound efficiency of the thermoacoustic device 10 can be improved.

The material of the insulating layer 164 is not limited. In one embodiment, the material of the insulating layer 164 can be a thermal insulated metal oxide. In one embodiment, the metal oxide can be a porous material, and have an electrically insulated property. The insulating layer 164 can be a metal oxide insulating layer defining a plurality of micropores therein. The metal oxide insulating layer can be formed by oxygenating a surface of the metal substrate 162, thus an interface between the insulating layer 164 and the metal substrate 162 can be ambiguous. A thickness of the metal oxide insulating layer may be less than or equal to 100 micrometers. Simultaneously, the support element 16 can be a metal matrix. A side of metal matrix can include more metal oxide therein or substantially be consisted of metal oxide, thus, the side of the metal matrix can be the metal oxide insulating layer. When the sound wave generator 14 is located on the metal oxide insulating layer, microscopically, a part of the sound wave generator 14 can be attached to the metal oxide insulating layer, and the other part of the sound wave generator 14 can be suspended over the plurality of micropores defined in the metal oxide insulating layer. The material of the metal substrate 162 can be aluminum, iron, copper, or any combination thereof. Thus, the insulating layer 164 can be alumina ($Al_2O_3$), ferric oxide ($Fe_2O_3$), iron oxide black ($Fe_3O_4$), copper oxide (CuO) or any combination thereof.

The material of the insulating layer 164 can be made of a high-temperature resistance and electrically insulated material, such as, a paint or an insulated polymer. The insulating layer 164 can be formed by coating a layer of high-temperature paint or a layer of high-temperature and electrically insulated polymer on the metal substrate 162. In one embodiment, the insulating layer 164 is patterned to cause a smooth surface of the insulating layer 164. The insulated polymer can be silica gel or acrylic.

In one embodiment, the support element 16 is a flat structure, and consist of an aluminum substrate and an alumina insulating layer. The thickness of the aluminum substrate can be about 5 millimeters. The alumina insulating layer can be formed by oxygenating a surface of the aluminum substrate. The alumina insulating layer can have a thickness of about 40 micrometers. The surface of the alumina insulating layer can define a plurality of micropores therein. Microscopically, a part of the sound wave generator 14 is suspended over the plurality of micropores defined in the alumina insulating layer, and the other part of the sound wave generator 14 is located on the alumina insulating layer.

Alumina is a porous material. Thus, the sound wave generator 14 can have a large contact area with air or other medium, which can improve the sound efficiency of the thermoacoustic device 10. Alumina has good thermal insulation properties. Therefore, the alumina insulating layer 164 can avert the heat emitting from the sound wave generator 14 from being excessively absorbed by the support element 16.

The alumina insulating layer 164 can be formed by directly oxygenating the aluminum substrate 162. Thus, the cost of fabricating the support element 16 can be decreased. The aluminum having a good plasticity can easily be made into various shapes. Thus, the support element 16 can be easily formed into various shapes. In addition, aluminum has a good flexibility and intensity, thus, the support element 16 including the aluminum can have a good flexibility and intensity. Therefore, the thermoacoustic device 10 including the aluminum can be flexible, high anti-shake properties and can prevent the sound wave generator 14 from being broken up.

The sound wave generator 14 receives signals sent from the signal element 12 and sends corresponding sound waves. The sound wave generator 14 is located on the support element 16, thus, the support element 16 can determine the shape of the sound wave generator 14. The sound wave generator 14 is attached to a surface of the insulating layer 164 to make the sound wave generator 14 have a planar surface and/or a curved surface. In one embodiment, the support element 16 is a flat structure, thus, the sound wave generator 14 can be a flat sound wave generator 14.

The sound wave generator 14 includes a carbon nanotube structure. The heat capacity per unit area of the carbon nanotube structure can be less than $2\times10^{-4}$ J/cm$^2$*K. The carbon nanotube structure can have different structures and a large specific surface area. The carbon nanotube structure can include a plurality of carbon nanotubes uniformly distributed therein, and the carbon nanotubes therein can be combined by van der Waals attractive force therebetween. It is understood that the carbon nanotube structure must include metallic carbon nanotubes. The carbon nanotubes in the carbon nanotube structure can be arranged orderly or disorderly. The term "disordered carbon nanotube structure" includes a structure where the carbon nanotubes are arranged along many different directions, arranged such that the number of carbon nanotubes arranged along each different direction can be almost the same (e.g. uniformly disordered); and/or entangled with each other. "Ordered carbon nanotube structure" includes a structure where the carbon nanotubes are arranged in a consistently systematic manner, e.g., the carbon nanotubes are arranged approximately along a same direction and or have two or more sections within each of which the carbon nanotubes are arranged approximately along a same direction (different sections can have different directions). The carbon nanotubes in the carbon nanotube structure can be selected from single-walled, double-walled, and/or multi-walled carbon nanotubes. It is also understood that there may be many layers of ordered and/or disordered carbon nanotube films in the carbon nanotube structure.

The carbon nanotube structure includes at least one carbon nanotube film, at least one linear carbon nanotube structure or combination thereof. The carbon nanotube film can include a plurality of ordered carbon nanotubes or disordered carbon nanotubes. The plurality of carbon nanotubes in the carbon nanotube film is substantially parallel to a surface of the carbon nanotube film. The linear carbon nanotube structure can be a carbon nanotube wire, a plurality of carbon nanotube wires substantially parallel to each other to form an untwisted cables, or twisted with each other to form a twisted cable.

The carbon nanotube structure includes a plurality of linear carbon nanotube structures. A heat capacity per unit area of the linear carbon nanotube structure can be less than $2\times10^{-4}$ J/cm$^2$*K. In one embodiment, the heat capacity per unit area of the linear carbon nanotube structure is less than $5\times10^{-5}$ J/cm$^2$*K. The plurality of linear carbon nanotube structures also can be woven into a sheet structure. The linear carbon nanotube structure can be an untwisted carbon nanotube wire or a twisted carbon nanotube wire. The untwisted carbon nanotube wire includes a plurality of carbon nanotubes substantially oriented along a same direction, and the plurality of carbon nanotubes is substantially parallel to the axis of the untwisted carbon nanotube wire. The twisted carbon nanotube wire includes a plurality of carbon nanotubes oriented around an axial direction of the twisted carbon nanotube wire, and the plurality of carbon nanotubes is aligned around the axis of the carbon nanotube twisted wire like a helix.

The carbon nanotube structure may have a substantially planar structure. The thickness of the carbon nanotube structure may range from about 0.5 nanometers to about 1 millimeter. The smaller the specific surface area of the carbon nanotube structure, the greater the heat capacity will be per unit area. The larger the heat capacity per unit area, the smaller the sound pressure level of the thermoacoustic device. The heat capacity per unit area of the carbon nanotube structure can be less than $2\times10^{-4}$ J/cm$^2$*K. In one embodiment, the heat capacity per unit area of the carbon nanotube structure is less than or equal to about $1.7\times10^{-6}$ J/cm$^2$*K.

Figure 2:
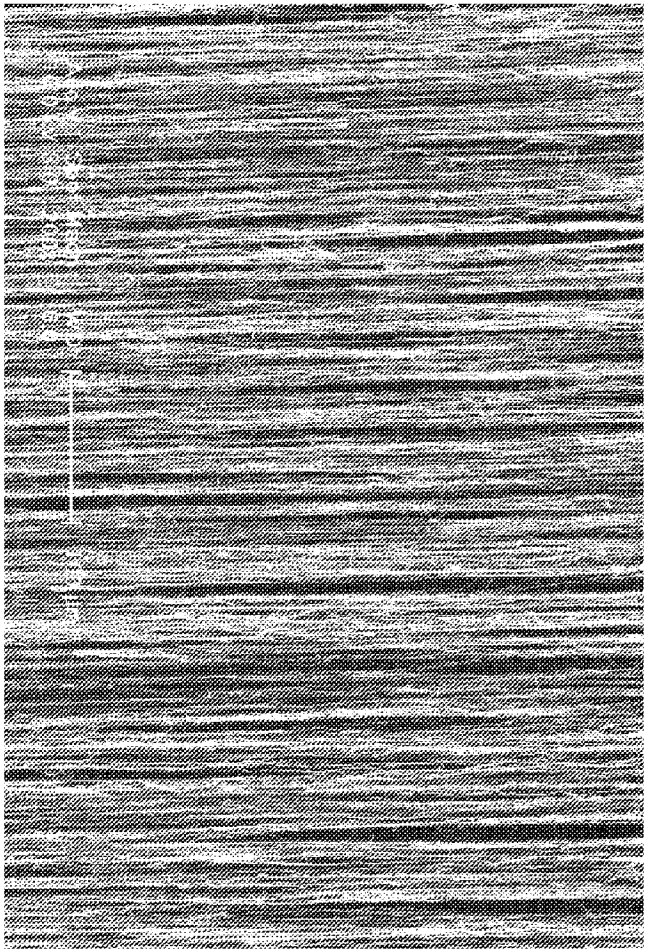
FIG. 2 shows a Scanning Electron Microscope image of a carbon nanotube film.

In one embodiment, the sound wave generator 14 is a layer of carbon nanotube film as shown in FIG. 2. The carbon nanotube film includes a plurality of successive and oriented carbon nanotubes joined end-to-end by van der Waals attractive force therebetween. The carbon nanotubes in the carbon nanotube film can be substantially aligned in a single direction. The carbon nanotube film defines a first direction and a second direction. The first direction is the direction in which the carbon nanotubes are arranged in the carbon nanotube film. The second direction is substantially parallel to the surface of the carbon nanotube film and intersects with the first direction. The carbon nanotube film has an anisotropic conductive property. The resistance per square of the carbon nanotube film in the second direction is more than that in the first direction. If the second direction is substantially perpendicular to the first direction, the resistance per square in the second direction is about 70 times more than that in the first direction. In one embodiment, the resistance per square in the second direction is about $2.5\times10^5\Omega$, the resistance per square in the first direction is about $3\times10^3\Omega$. The thickness of the carbon nanotube film is about 50 nanometers.

Since the carbon nanotubes structure has a large specific surface area, the sound wave generator 14 can be adhered directly on the support element 16 in good contact.

An adhesive layer (not shown) can be further provided between the sound wave generator 14 and the support element 16. The adhesive layer can be located on the surface of the sound wave generator 14. The adhesive layer can provide a better bond between the sound wave generator 14 and the support element 16. In one embodiment, the adhesive layer is conductive and a layer of silver paste is used. A thermally insulated adhesive can also be selected as the adhesive layer.

The first electrode 142 and the second electrode 144 are made of conductive material. The shape of the first electrode 142 or the second electrode 144 is not limited and can be lamellar, rod, wire, and block among other shapes. Materials of the first electrode 142 and the second electrode 144 can be metals, conductive adhesives, carbon nanotubes, and indium tin oxides among other materials. In one embodiment, the first electrode 142 and the second electrode 144 are rod-shaped metal electrodes. The first electrode 142 and the second electrode 144 are substantially parallel to each other. The first electrode 142 and the second electrode 144 are located at the two ends of the carbon nanotube film, and the carbon nanotubes in the sound wave generator 14 substantially extended from the first electrode 142 to the second electrode 144. The sound wave generator 14 is electrically connected to the first electrode 142 and the second electrode 144. The electrodes can provide structural support for the sound wave generator 14. Because, some of the carbon nanotube structures have large specific surface area, some sound wave generators 14 can be adhered directly to the first electrode 142 and the second electrode 144 and/or many other surfaces. This will result in a good electrical contact between the sound wave generator 14 and the electrodes 142, 144. The first electrode 142 and the second electrode 144 can be electrically connected to two ends of the signal element 12 by a conductive wire 149.

In other embodiments, a conductive adhesive layer (not shown) can be further provided between the first electrode 142 or the second electrode 144 and the sound wave generator 14. The conductive adhesive layer can be applied to the surface of the sound wave generator 14. The conductive adhesive layer can be used to provide electrical contact and more adhesion between the electrodes 142 or 144 and the sound wave generator 14. In one embodiment, the conductive adhesive layer is a layer of silver paste.

The signal element 12 can include the electrical signal elements, pulsating direct current signal elements, alternating current devices and/or electromagnetic wave signal elements (e.g., optical signal elements, lasers). The signals input from the signal element 12 to the sound wave generator 14 can be, for example, electromagnetic waves (e.g., optical signals), electrical signals (e.g., alternating electrical current, pulsating direct current signals, signal elements and/or audio electrical signals) or a combination thereof. Energy of the signals is absorbed by the carbon nanotube structure and then radiated as heat. This heating causes detectable sound signals due to pressure variation in the surrounding (environmental) medium. It can be understood that the signals are different according to the specific application of the thermoacoustic device 10. When the thermoacoustic device 10 is applied to an earphone, the input signals can be AC electrical signals or audio signals. When the thermoacoustic device 10 is applied to a photoacoustic spectrum device, the input signals are optical signals. In one embodiment, the signal element 12 is an electric signal element, and the input signals are electric signals. The signal element 32 can be connected to the sound wave generator 34 directly via a conductive wire. Anyway that can electrically connect the signal element 32 to the sound wave generator 34 and thereby input signal to the sound wave generator 34 can be adopted.

It also can be understood that the first electrode 142 and the second electrode 144 are optional according to different signal elements 12, e.g., when the signals are electromagnetic wave or light, the signal element 12 can input signals to the sound wave generator 14 without the first electrode 142 and the second electrode 144.

The carbon nanotube structure comprises a plurality of carbon nanotubes and has a small heat capacity per unit area. The carbon nanotube structure can have a large area for causing the pressure oscillation in the surrounding medium by the temperature waves generated by the sound wave generator 14.

In use, when signals, e.g., electrical signals, with variations in the application of the signal and/or strength are input applied to the carbon nanotube structure of the sound wave generator 14, heating is produced in the carbon nanotube structure according to the variations of the signal and/or signal strength. Temperature waves, which are propagated into surrounding medium, are obtained. The temperature waves produce pressure waves in the surrounding medium, resulting in sound generation. In this process, it is the thermal expansion and contraction of the medium in the vicinity of the sound wave generator 14 that produces sound. This is distinct from the mechanism of the conventional loudspeaker, in which the pressure waves are created by the mechanical movement of the diaphragm. When the input signals are electrical signals, the operating principle of the thermoacoustic device 10 is an "electrical-thermal-sound" conversion. When the input signals are optical signals, the operation principle of the thermoacoustic device 10 is an "optical-thermal-sound" conversion. Energy of the optical signals can be absorbed by the sound wave generator 14 and the resulting energy will then be radiated as heat. This heat causes detectable sound signals due to pressure variation in the surrounding (environmental) medium.

Figure 3:
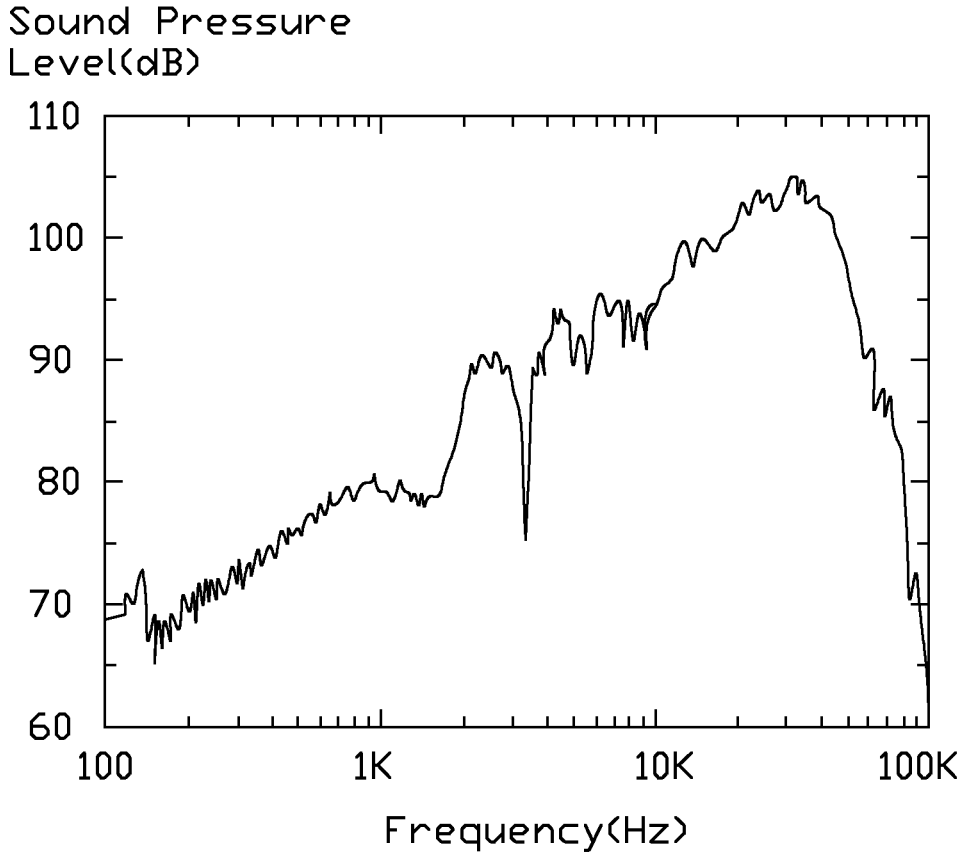
FIG. 3 is a frequency response curve of the thermoacoustic device displayed in FIG. 1.

FIG. 3 shows a frequency response curve of the thermoacoustic device 10 according to the embodiment described in FIG. 1. To obtain these results, an alternating electrical signal with 50 volts is applied to the carbon nanotube structure. A microphone put about 5 centimeters away from the in front of the sound wave generator 14 is used to measure the performance of the thermoacoustic device 10. As shown in FIG. 2, the thermoacoustic device 10, of the embodiment shown in FIG. 1, has a wide frequency response range and a high sound pressure level (SPL). The sound pressure level of the sound waves generated by the thermoacoustic device 10 can be greater than 50 dB. The sound pressure level generated by the thermoacoustic device 10 reaches up to 105 dB. The frequency response range of the thermoacoustic device 10 can be from about 1 Hz to about 100 KHz with power input of 4.5 W. The total harmonic distortion of the thermoacoustic device 10 is extremely small, e.g., less than 3% in a range from about 500 Hz to 40 KHz.

Further, since the carbon nanotube structure has an excellent mechanical strength and toughness, the carbon nanotube structure can be tailored to any desirable shape and size, allowing a thermoacoustic device 10 of most any desired shape and size to be achieved. The thermoacoustic device 10 can be applied to a variety of other acoustic devices, such as sound systems, mobile phones, MP3s, MP4s, TVs, computers, and so on.

Figure 4:
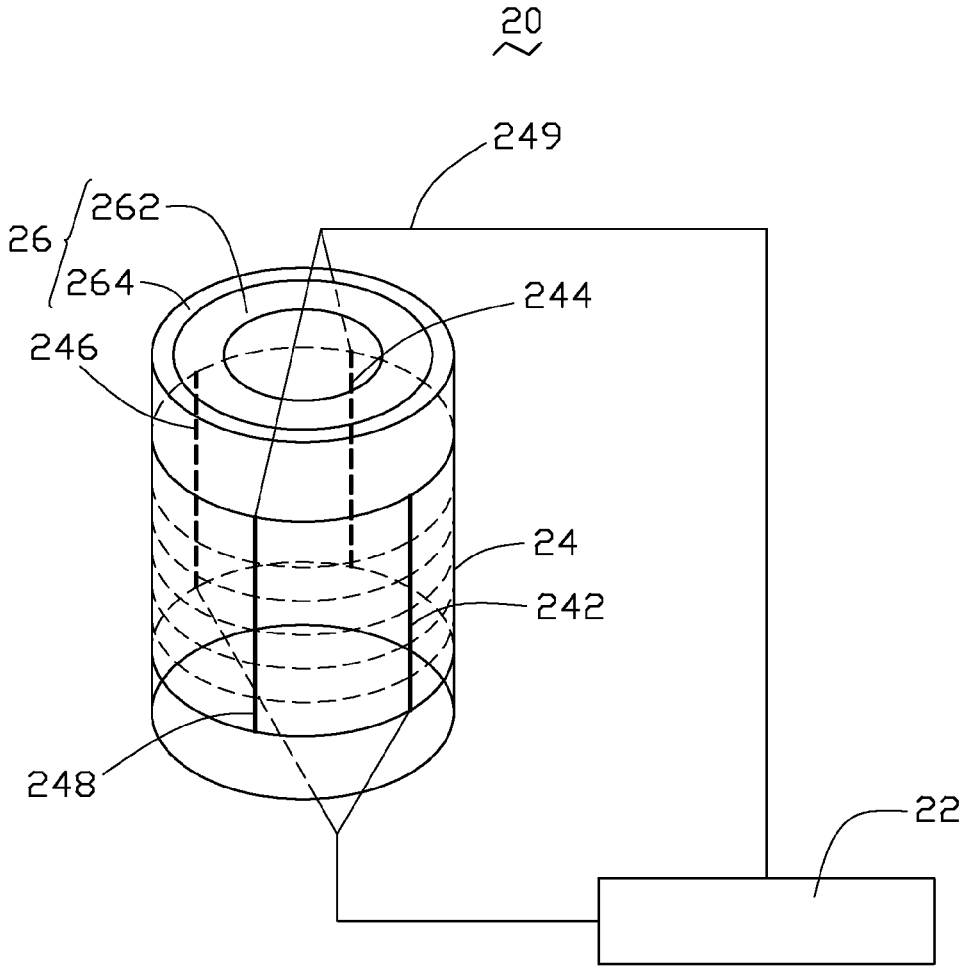
FIG. 4 is a schematic structural view of a thermoacoustic device in accordance with one embodiment.

Referring to FIG. 4, an thermoacoustic device 20 according to another embodiment includes a signal element 22, a sound wave generator 24, a first electrode 242, a second electrode 244, a third electrode 246, a fourth electrode 248, and a support element 26. The support element 26 includes a metal substrate 262 and an insulating layer 264 located on the metal substrate 262.

The compositions, features and functions of the thermoacoustic device 20 in the embodiment shown in FIG. 4 are similar to the thermoacoustic device 10 in the embodiment shown in FIG. 1. The difference is that the sound wave generator 24 as shown in FIG. 4 surrounds the support element 26. A shape of the support element 26 is not limited, and can be most any three or two dimensional structure, such as a cube, a cone, or a cylinder.

In one embodiment, the support element 26 is cylinder-shaped. The metal substrate 262 is made of copper. The insulating layer 264 is a layer of paint coated on the copper substrate. The sound wave generator 24 is attached on the paint insulating layer. The first electrode 242, the second electrode 244, the third electrode 246, and the fourth electrode 248 are separately located on a surface of the sound wave generator 24 and electrically connected to the sound wave generator 24. Connections between the first electrode 242, the second electrode 244, the third electrode 246, the fourth electrode 248 and the signal element 22 can be the same as described as that of the thermoacoustic device 10. It can be understood that a number of electrodes other than four can be in contact with the sound wave generator 24.

According to the above descriptions, the thermoacoustic devices of the present disclosure have the following advantages.

First, the thermoacoustic devices of the present disclosure employing the metal substrate and the insulating layer as the support element. The insulating layer is attached to the metal substrate, and the sound wave generator is attached to the insulating layer. Thus, the thermoacoustic device can use not only metal material as the support element, but also can avert the sound wave generator shorting circuit with the support element.

Second, the manufacturing techniques for making metal, oxygenating treatment methods and coating methods are well known and easy to perform. Thus, methods for making the support element have a low cost. Further, the methods for making the thermoacoustic device are easy and convenient for application.

Third, the metal substrates comprises metal materials, which have a good plasticity, as such it is easy to be made into various shapes. Therefore, the support elements can easily form various shapes. In addition, metal materials have a good flexibility and intensity, thus, the support elements can have good flexibility and intensity. Therefore, the thermoacoustic devices can be flexible, have high anti-shake properties, and are prevented from breaking up.

It is to be understood that the above-described embodiment is intended to illustrate rather than limit the disclosure. Variations may be made to the embodiment without departing from the spirit of the disclosure as claimed. The above-described embodiments are intended to illustrate the scope of the disclosure and not restricted to the scope of the disclosure.

What is claimed is:

1. A thermoacoustic device, comprising:

a signal element configured to transmit a signal;

a sound wave generator comprising a carbon nanotube structure, the carbon nanotube structure configured to receive the signal and generate a sound wave; and a support element comprising a metal substrate and an insulating layer disposed on the metal substrate, the insulating layer defines a plurality of micropores, and the carbon nanotube structure being directly located on the insulating layer.

2. The thermoacoustic device of claim 1, wherein a shape of the support element is a cube, a cone, a cylinder, a sphere, or a semi-sphere.

3. The thermoacoustic device of claim 1, wherein a material of the metal substrate is a pure metal or an alloy.

4. The thermoacoustic device of claim 3, wherein a material of the insulating layer is paint, insulted polymer, or metal oxide.

5. The thermoacoustic device of claim 1, wherein a material of the metal substrate is aluminum, iron, copper, or any combination thereof.

6. The thermoacoustic device of claim 5, wherein a material of the insulating layer is alumina, ferric oxide, iron oxide black, copper oxide or any combination thereof.

7. The thermoacoustic device of claim 1, wherein the insulating layer defines a plurality of micropores, and the carbon nanotube structure is suspended over the plurality of micropores.

8. The thermoacoustic device of claim 1, wherein a thickness of the insulating layer is less than or equal to 100 microns.

9. The thermoacoustic device of claim 1, wherein a resistance ratio of the insulating layer to the sound wave generator is more than or equal to 10.

10. The thermoacoustic device of claim 1, wherein the carbon nanotube structure comprises a plurality of carbon nanotubes, and the plurality of carbon nanotubes is combined via van der Waals force to form a free standing structure.

11. The thermoacoustic device of claim 10, wherein the plurality of carbon nanotubes are substantially aligned along a same direction.

12. The thermoacoustic device of claim 1, wherein the carbon nanotube structure is a carbon nanotube film having anisotropic conductive properties.

13. The thermoacoustic device of claim 12, wherein the carbon nanotube film comprises a plurality of carbon nanotubes substantially extended along a first direction, and defines a second direction that intersects with the first direction, a resistance of the carbon nanotube film in the second direction is more than that of the carbon nanotube film in the first direction.

14. The thermoacoustic device of claim 13, further comprising two electrodes, wherein the two electrodes are electrically connected to the carbon nanotube film.

15. The thermoacoustic device of claim 14, wherein the two electrodes are located at two ends of the carbon nanotube film along the first direction and spaced from each other.

16. The thermoacoustic device of claim 14, further comprising a conductive adhesive layer located between each of the two electrodes and the carbon nanotube film.

17. A thermoacoustic device, comprising:

a signal element configured to transmit a signal;

a sound wave generator comprising a carbon nanotube structure, the carbon nanotube structure configured to receive the signal and generate a sound wave; and a support element, the support element comprising a metal substrate and an insulating layer sandwiched between the metal substrate and the carbon nanotube structure, and the insulating layer comprising a metal oxide.

18. The thermoacoustic device of claim 17, wherein a material of the metal substrate is aluminum, iron, copper, or any combination thereof.

19. The thermoacoustic device of claim 18, wherein the insulating layer is formed by oxygenating a surface of the metal substrate; and the metal oxide is alumina, ferric oxide, iron oxide black, copper oxide, or any combination thereof.

20. The thermoacoustic device of claim 17, wherein the carbon nanotube structure comprises a carbon nanotube film comprising a plurality of carbon nanotubes substantially oriented along the same direction.

* * * * *